US006991396B2

(12) United States Patent
Gueret

(10) Patent No.: US 6,991,396 B2
(45) Date of Patent: Jan. 31, 2006

(54) APPLICATION DEVICE AND RELATED METHOD

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 211 days.

(21) Appl. No.: 09/964,488

(22) Filed: Sep. 28, 2001

(65) Prior Publication Data

US 2002/0038661 A1 Apr. 4, 2002

(30) Foreign Application Priority Data

Sep. 28, 2000 (FR) ..... 00 12357

(51) Int. Cl.
*A45D 40/26* (2006.01)

(52) U.S. Cl. ..... 401/191; 132/320

(58) Field of Classification Search ..... 132/317, 132/320, 108, 311, 315, 73, 74.5, 76.2, 218; 401/130, 125, 191, 126, 128, 129; 15/185; 206/229

See application file for complete search history.

(56) References Cited

U.S. PATENT DOCUMENTS

| | | | | |
|---|---|---|---|---|
| 3,734,118 | A * | 5/1973 | Howard | 132/311 |
| 3,741,667 | A * | 6/1973 | Cesari | 401/175 |
| 4,056,110 | A * | 11/1977 | Landsman | 132/311 |
| 4,360,020 | A | 11/1982 | Hitchcock, Jr. et al. | |
| 4,759,381 | A * | 7/1988 | Cesari | 132/311 |
| 4,941,226 | A * | 7/1990 | Kemper | 15/185 |
| 5,348,031 | A * | 9/1994 | Cloud | 132/317 |
| 5,382,107 | A * | 1/1995 | Nian | 401/191 |
| 5,492,426 | A | 2/1996 | Gueret | |
| 5,538,022 | A * | 7/1996 | Bennett | 132/318 |
| 5,895,162 | A * | 4/1999 | Gueret | 401/125 |
| 6,158,913 | A * | 12/2000 | Dumler et al. | 401/191 |
| 6,305,863 | B1 | 10/2001 | Gueret | |
| 6,309,124 | B1 | 10/2001 | Gueret | |
| 6,450,720 | B1 * | 9/2002 | Cai | 401/193 |
| 2001/0031168 | A1 | 10/2001 | Gueret | |

FOREIGN PATENT DOCUMENTS

| | | |
|---|---|---|
| DE | 298 24 107 | 6/2000 |
| EP | 1 020 135 | 7/2000 |
| EP | 1 136 056 A1 | 9/2001 |
| FR | 1 425 166 | 12/1965 |
| JP | 62-179951 | 11/1987 |
| JP | 63-98109 | 6/1988 |
| JP | 10-295437 | 11/1998 |
| JP | 2000-245529 | 9/2000 |

OTHER PUBLICATIONS

Co-pending U.S. Appl. No. 10/060,234; Device for Applying a Product, Jean-Louis H. Gueret, filed Feb. 1, 2002.
English language Derwent Abstract of DE 298 24 107, Jun. 21, 2000.

* cited by examiner

*Primary Examiner*—Todd E. Manahan
(74) *Attorney, Agent, or Firm*—Finnegan, Henderson, Farabow, Garrett & Dunner, L.L.P.

(57) ABSTRACT

A device for applying a product comprises a receptacle body defining a reservoir configured to contain a product and an application element configured to apply a product to a surface. A cavity is in flow communication with the reservoir and configured to receive the application element. The device further comprises a support element on which the application element is mounted. The support element is mounted to pivot relative to the receptacle body between a first position wherein the application element is received in the cavity and a second position wherein the application element is at least partially exposed so as to be capable of coming into contact with a surface to which product is to be applied.

166 Claims, 4 Drawing Sheets

APPLICATION DEVICE AND RELATED METHOD

The present invention relates to a device and related method for dispensing and applying a product, such as, for example, a cosmetic product or a care product to a surface, such as, for example, skin, hair, toenails, fingernails.

In particular, the invention relates to a device of the type comprising an application element for applying the product in combination with a reservoir for containing the product, wherein the device includes a cavity for receiving the application element. The cavity may be fed with product coming from the reservoir. The device may be relatively simple to use.

In accordance with an optional aspect of the invention, a device for applying a product comprises a receptacle body defining a reservoir configured to contain a product and an application element configured to apply a product to a surface. The device also may comprise a cavity in flow communication with the reservoir and configured to receive the application element, and a support element on which the application element is mounted.

The support element may be mounted to pivot relative to the receptacle body between a first position (e.g., a closed position) wherein the application element is received in the cavity and a second position (e.g., a ready position) wherein the application element is at least partially exposed so as to be capable of coming into contact with a surface to which product is to be applied.

As used herein the terms "first" and "second" are used merely as a matter of convenience to designate two positions without being intended to imply there is any particular order in which the support element is moved from one position to the other. Moreover, although the device according to certain exemplary embodiments could be capable of moving multiple times to and from the first and second positions, some exemplary embodiments could be arranged so there is only a single movement or a limited number of movements from one position to another during use.

The receptacle body optionally may be adapted to be used as a handle for holding the application element during application of product to the surface. This may enable the support element for the application element to be compact.

According to yet another optional aspect, the invention may include a device for applying a product, the device comprising a receptacle body defining a reservoir configured to contain a product and an application element configured to apply a product to a surface. A cavity may be in flow communication with the reservoir and configured to receive the application element. The device may further comprise a support element on which the application element is mounted. The support element may be mounted to move between a first position wherein the application element is received in the cavity and a second position wherein the application element is at least partially exposed so as to be capable of coming into contact with a surface to which product is to be applied. The receptacle body may be configured to be used as a handle portion for holding the device during application of product to the surface when the support element is in the second position.

In yet another optional aspect of the invention, a device for applying a product comprises a receptacle body defining a reservoir configured to contain a product and an application element configured to apply a product. A cavity may be in flow communication with the reservoir and configured to receive the application element. The device may also comprise a support element on which the application element is mounted, the support element being connected to the receptacle body. The support element may be mounted to move between a first position wherein the application element is received in the cavity and a second position wherein the application element is at least partially exposed so as to be capable of coming into contact with a surface to which product is to be applied. The support element may be configured to remain connected to the receptacle body in the second position.

The device may permit the application element to be put into a position such that it is ready for use via an action that is relatively simple. For example, the action might substantially prevent a risk of the application element escaping and a risk that the application element comes into contact with a surface that might dirty it.

The support element may be made integrally with a portion of the reservoir, thereby optionally reducing the number of component parts and simplifying manufacture of the device.

Optionally, the support element may be configured to close the cavity when the support element is in the first position. The support element may be configured to hermetically seal the cavity when the support element is in the first position. Further, the device may comprise a sealing member configured to provide the hermetic sealing when the support element is in the first position.

The support element may be configured to pivot over an angular movement that is at least approximately 120°. Optionally, the support element may be configured to pivot over an angular movement that is at least approximately 180°. This may enable the application element to be brought to a position in which it is thoroughly disengaged.

Certain embodiments might be configured so that the support element moves between the first and second positions without any pivoting or with only a portion of the movement being pivotal. For example, the support element might move in a linear or curved path without any pivoting, and/or there could be an at least partial rotational motion.

The application element may be made of any type of material. Optionally, the application element may be made of a compressible material, such as, for example, an open-celled foam. The application element may also optionally be made of either a semi-open celled or closed celled foam. Also optionally, the application element may be made of a sintered material. Further, the application element optionally may be absorbent.

According to an optional aspect, the application element may be configured to be in a compressed configuration when the support element is in the first position (e.g., when the application element is received in the cavity). According to another optional aspect, the application element may be configured to be in an uncompressed configuration when the support element is in the first position.

In an exemplary embodiment, a hinge member is associated with the support element and the support element is configured to pivot about the hinge member. The hinge member may comprise a film hinge. The device may further comprise a head portion associated with the receptacle body and the hinge member may connect the support element to the head portion. The hinge member optionally may connect the support element directly to the receptacle body. The hinge member may comprise at least one pivot configured to pivot in a housing. The hinge member may be configured to snap-fasten to at least one of the support element and the receptacle body. As an option, the hinge member may be spring-biased.

The head portion may define a cavity. Optionally, the head portion may define an internal passage configured to place the cavity in flow communication with the reservoir. The receptacle body optionally may comprise a neck portion and the head portion may be configured to engage with the neck portion. As another option, the head portion and the receptacle body may be formed as a single piece. As yet another option, the head portion may be removably attached to the receptacle body.

Optionally, the receptacle body is made of a relatively flexible material or a relatively rigid material.

According to another optional aspect, the device may comprise a securing (e.g., locking) mechanism for securing the support element in the first position. The securing mechanism may be in the form of a snap-fastener and the support element may snap-fasten to the receptacle body when the support element is in the first position. Also optionally, the device may comprise a securing (e.g., locking) mechanism for securing the support element in the second position. The securing mechanism may be in the form of a snap-fastener and the support element may snap-fasten to the receptacle body when the support element is in the second position.

As yet another option, a longitudinal axis of the cavity may be substantially parallel to a longitudinal axis of the receptacle body. The longitudinal axis of the cavity also may be substantially coincident with the longitudinal axis of the receptacle body. Also optionally, the longitudinal axis of the cavity may be at an angle relative to the longitudinal axis of the receptacle body. The longitudinal axis of the cavity also may be substantially perpendicular to the longitudinal axis of the receptacle body.

The device may be configured such that flow of a product from the reservoir into the cavity is along a direction that is substantially perpendicular to the axis about which the support element is configured to pivot. The longitudinal axis of the application element optionally may be substantially parallel to a longitudinal axis of the receptacle body when the support element is in the second position. Also as an option, the longitudinal axis of the application element forms a non-zero angle with the longitudinal axis of the receptacle body when the support element is in the second position. Optionally, the longitudinal axis of the application element may be perpendicular to the longitudinal axis of the receptacle body when the support element is in the second position. The relative positions of the longitudinal axes of the application element and of the receptacle body may be selected so as to form an ergonomically suitable applicator device and may depend on the type of application desired.

Optionally, the support element may be capable of pivoting through an angle of at least approximately 210° when the support element moves from the first position to the second position.

The cavity optionally opens out substantially on a side that is opposite from the side where the application element is disposed when the support element is in the second position. This may make it possible to avoid the surface against which the application element is applied coming into contact with an edge of the cavity during application. Moreover, this may avoid the surface becoming coated in non-desired manner with a residue of the product present proximate the cavity.

The cavity may be defined at least partially by a wall, such as a bottom wall, for example, defining at least one opening configured to provide flow communication between the reservoir and the cavity. The at least one opening may be configured to permit flow of the product from the reservoir into the cavity so as to load the application element with the product when the support element is in the first position. Optionally, the wall may define a plurality of openings. Also optionally, the at least one opening may be at least one capillary opening.

The application element may be compressible and the device may be configured such that product flows through the at least one opening during expansion of the application element from a compressed configuration to an uncompressed configuration when the support element moves from the first position to the second position. This may enable the application element to become loaded with the product from the reservoir.

Optionally, the product flows into the cavity in a direction that is substantially perpendicular to the hinge axis of the support element.

The application element optionally may be loaded with the product while in the cavity by capillarity or by exerting pressure on the receptacle body.

Optionally, the device further comprises a product in the reservoir. The product may be chosen from a cosmetic product and a care product. A care product may be any type of care product for any type of surface. As an example, the care product may be a treatment product for a surface, such as, a body surface, for example.

According to yet another optional aspect of the invention, a method of applying a product to a surface comprises providing a device, such as any of the devices described above, and flowing a product toward the cavity to place the product in contact with at least a portion of the application element positioned in the cavity so as to load at least a portion of the application element with the product. The method may further comprise placing the support element in the second position and placing at least the loaded portion of the application element in contact with a surface so as to apply product to the surface.

As mentioned above, the method comprises "providing" a device. The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

The placing of the support element in the second position may optionally comprise pivoting the support element relative to the receptacle body. Optionally, the placing of the application element in contact with the surface comprises holding the receptacle body. Also optionally, the placing of the support element in the second position comprises securing the support element in the second position.

The flowing of the product from the reservoir to the cavity may comprise exerting pressure on an outside of the receptacle body. Alternatively, the application element may be compressible and the flowing of the product toward the cavity may optionally comprise permitting the application element to expand from a compressed configuration to an uncompressed configuration.

The method optionally may further comprise placing the support element in the first position after the product has been applied to the surface. The placing of the support element in the first position optionally comprises securing the support element in the first position. The securing of the support element in the first position may comprise snap-fastening the support element relative to the receptacle body.

The flowing of the product toward the cavity optionally may comprise flowing the product through at least one opening defined in a wall defining the cavity.

As an option, the placing of the application element in contact with the surface may comprise placing the application element in contact with at least one of skin, hair, at least one toenail, and at least one fingernail.

The devices and methods of dispensing described herein may optionally solve some or all of the problems discussed above. It should be understood that the invention could be practiced without performing one or more of the aspects and/or advantages described above. Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a perspective view of a first exemplary embodiment of an application device according to the invention;

Reference will now be made in detail to exemplary embodiments of the invention, examples of which are illustrated in the accompanying drawings. Wherever possible, the same reference numbers are used in the drawings and the description to refer to the same or like parts.

Figure 1:
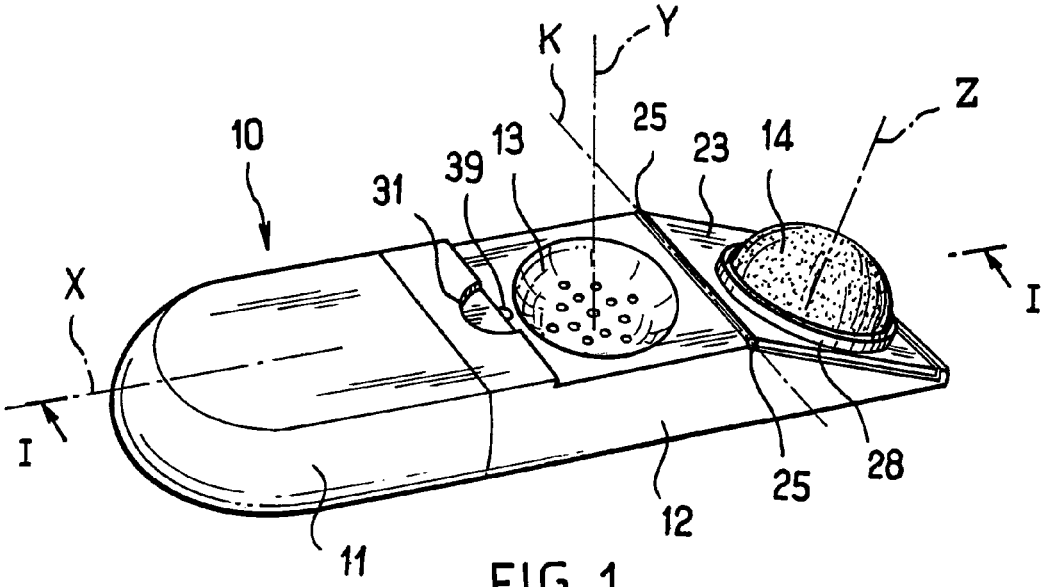

FIG. 1 shows an applicator device 10 according to a first exemplary embodiment of the invention. The device 10 optionally is intended for dispensing and applying a cosmetic or care product, for example a lotion or a sun cream. The device 10 may be used to apply any substance of fluid to pasty consistency, or optionally a powder.

Figure 2:
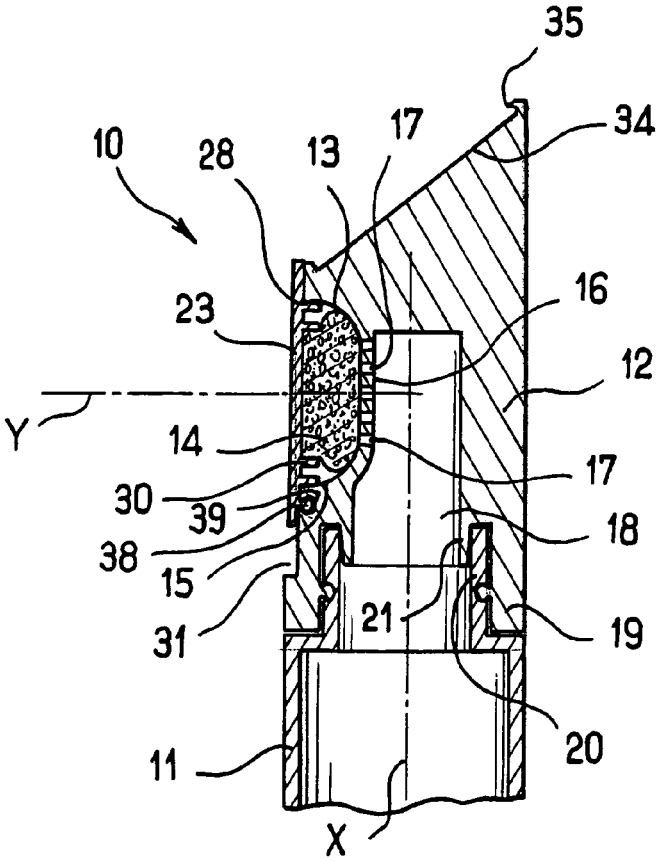
FIG. 2 is a cross-sectional view of the device of FIG. 1 taken along line I—I with a support element shown in a first position.

The device 10, shown partially in axial cross-section in FIG. 2, may comprise a receptacle body 11 having a longitudinal axis X and a head portion 12 on the receptacle body 11. The head portion 12 may define a cavity 13 in which an application element 14 may be received. The body 11 may define a reservoir for containing a product to be applied.

The cavity 13 optionally may be defined by a side wall 15 and by a bottom wall 16. The bottom wall 16 may be provided with one or more openings 17 in flow communication with the reservoir defined by the body 11. An internal passage 18 defined by the head portion 12 may place the openings 17 and the reservoir in flow communication.

The head portion 12 may include a skirt portion 19, optionally configured to snap-fasten on a neck portion 20 of the body 11. The neck portion 20 optionally may be formed integrally as a single piece with the body 11. The neck 20 also may be provided with a sealing lip 21 suitable for pressing in leakproof manner against the neck portion 20 so as to provide leakproof communication between the internal passage 18 and the reservoir defined by the body 11. The head portion 12 optionally may be formed with the receptacle body 11 as a single piece.

Optionally, the body 11 has a flexible wall so as to enable a user to expel the substance into the internal passage 18 and into the openings 17 by exerting pressure on the receptacle body, for example by pressing against the flexible wall.

The application element 14 may be carried by a support element 23. The support element 23 may be in the form of a flap provided on one side with two pivots 25 engaged in appropriate housings formed in the head portion 12. The support element 23 may have a sealing lip 28 suitable for bearing in leakproof manner against the side wall 15 when the support element 23 is in a closed position, as shown in FIG. 2, so as to close the cavity 13, optionally hermetically sealing the cavity. The support element 23 also has a securing mechanism 38 suitable for snap-fastening in a recess 39 of the head portion 12 in order to hold the support element 23 in the closed position.

The application element 14 may optionally be made of an open-celled foam, and may be fixed in an assembly skirt 30 formed integrally with the support element 23. It can be seen that in the embodiment of FIGS. 1 and 2, the axis Y of the cavity 13 is substantially perpendicular to the axis X of the receptacle body 11.

A recess 31 optionally may be formed in the head 12 in line with the support element 23 so as to enable the user to insert a fingernail, or the like, to lift the support element 23 and cause it to pivot through approximately 120° about a pivot axis K.

On its side opposite from the body 11, the head portion 12 may have a housing 34 arranged to receive the support element 23 in an open position. The edge of the housing 34 remote from the pivot axis K may define a small relief portion 35 enabling the support element 23 to be held in its open position by snap-fastening.

According to an optional aspect, the device may be used as follows. The user may begin by loading the application element 14 with product by exerting pressure on the receptacle body 11. The user may then pivot the support element 23 so as to bring it into the housing 34, after which the body 11 can be used as a handle while applying the substance to the skin, the hair, the nails, or the mucous membranes using the application element 14.

Various modifications may be made without going beyond the ambit of the present invention. For example, the way in which the application element is filled with product can be modified. For example, the application element may be compressible and the product may be loaded onto the application element as a result of expansion of the application element as the support element moves from a closed position to an open, ready position. In this manner, a capillary effect of the openings would assist in loading the application element with the product from the reservoir.

Moreover, the orientation of the axis of the housing in which the application element is received or the axis of the application element when it is in its ready position may be altered, for example, as a function of the kind of substance to be applied, of the zone of the body or the face to be treated, and of the desired manner of application.

Figure 3:
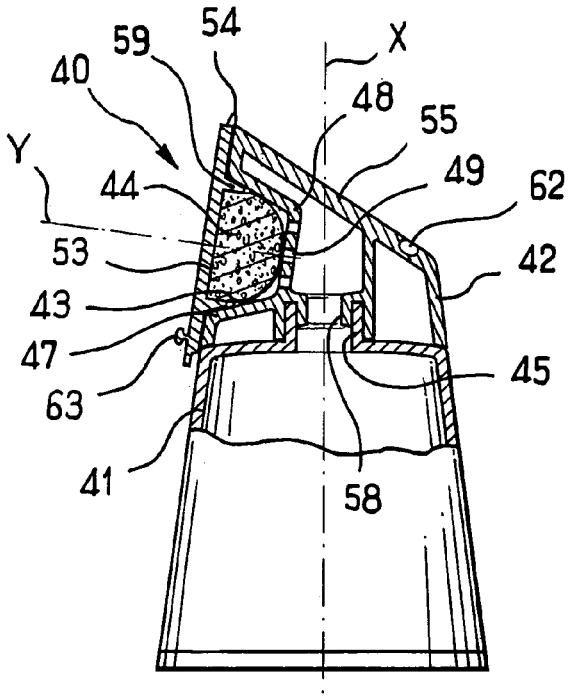
FIG. 3 is a cross-sectional view of a second exemplary embodiment of an application device with the support element shown in a first position.
Figure 4:
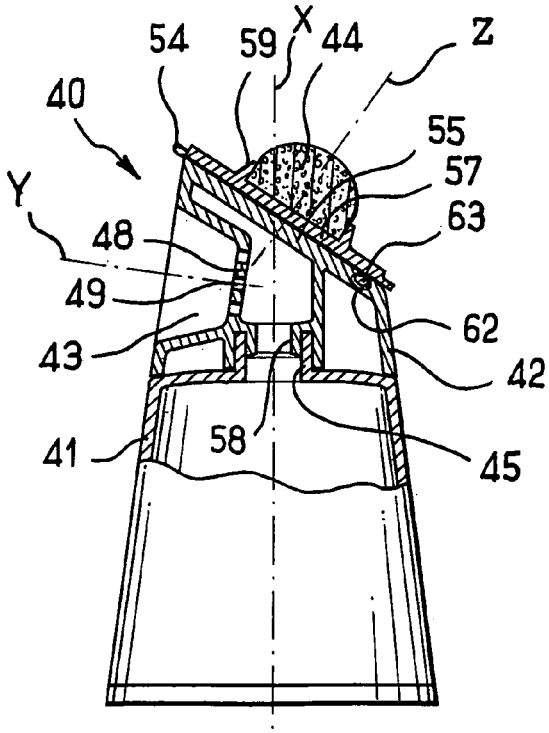
FIG. 4 is a cross-sectional view of the device of FIG. 3 with the support element shown in a second position.

FIGS. 3 and 4 show a device 40 according to another exemplary embodiment of the invention. In this example, the receptacle body 41 is in the form of a flexible tube provided with a head portion 42 fitted on the tube. The head portion 42 may define a cavity 43 for receiving an application element 44.

The body 41 may be associated with a neck portion 45 on an axis X. The axis Y of the cavity 43 may be at a non-zero angle of less than approximately 90° relative to the axis X.

Sealing lip 58 may be provided on the head portion 42 so as to press in leakproof manner against the neck portion 45.

The cavity 43 may be defined by a side wall 47 and by a bottom wall 48. The bottom wall 48 may define openings 49 for feeding the cavity 43 with product so as to load the application element 44. The application element 44 may be fixed to a support element 53, for example in the form of a flap, that optionally is connected via a film hinge 54 to a front wall 55 of the head portion 42.

The support element 53 optionally has a sealing lip 59 that may serve for assembling the application element 44. The sealing lip 59 may be suitable for bearing in a leakproof manner against the side wall 47 while holding the support element 53 by friction in its position for closing the housing 43.

The front wall 55 may have a cut-out portion 62 in which a stud 63 secured to the support element 53 may be snap-fastened after the support element 53 has been pivoted so as to place the application element in its ready position, as shown in FIG. 4.

It will be observed that in the embodiment of FIGS. 3 and 4, the axis Z of the application element when in its ready position is at an angle of more than 90° relative to the axis Y of the cavity 43. In this way, when the user applies the product while using the body 41 as a handle, the cavity 43 faces away from the application element 44. This may ensure that the surface to which the product is applied does not come into contact with the edges of the cavity 43.

Figure 5:
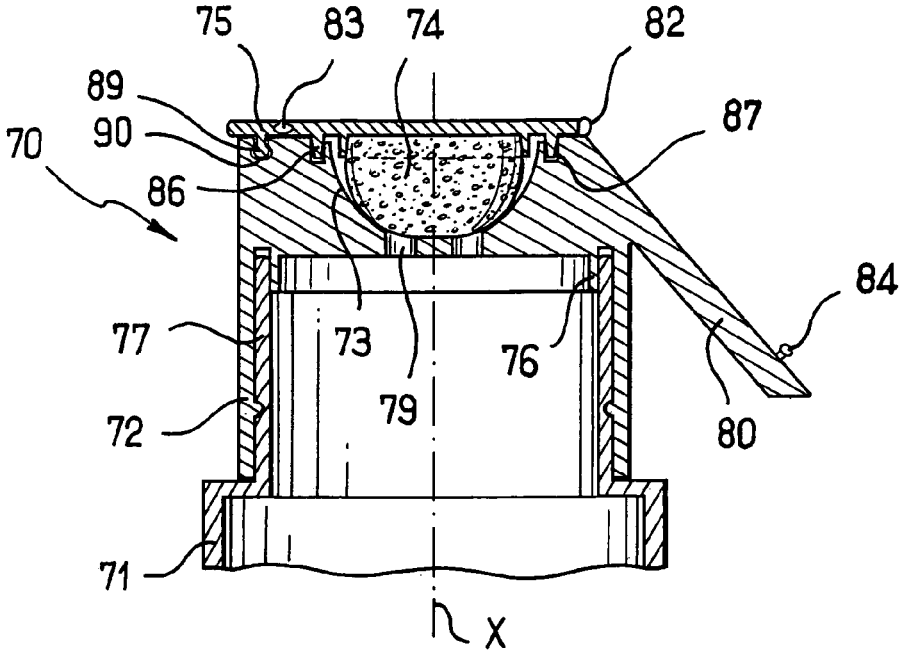
FIG. 5 is a partial cross-sectional view of a third exemplary embodiment of an application device.
Figure 6:
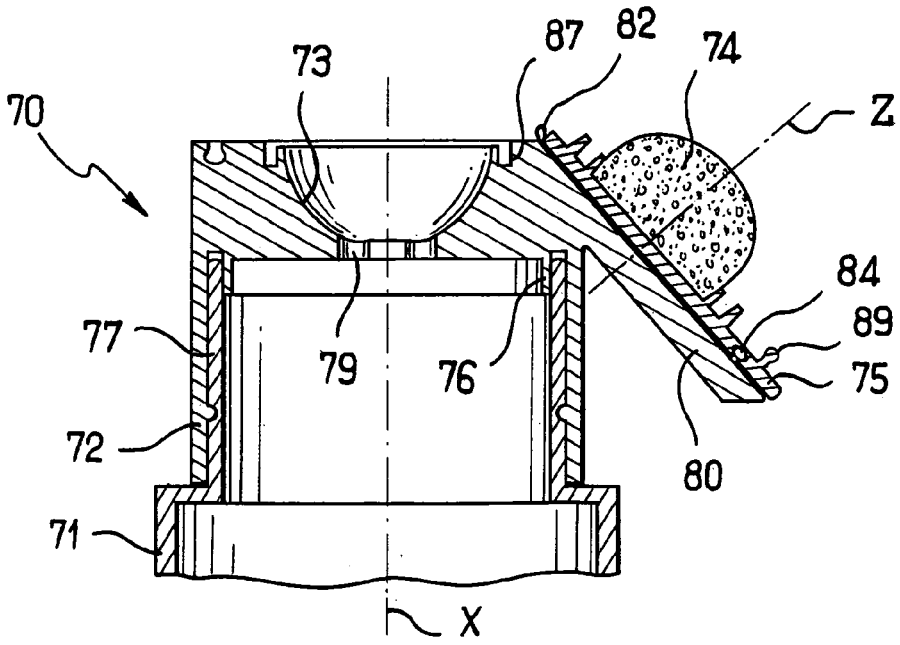
FIG. 6 is a cross-sectional view of the device of FIG. 5 showing the support element in the second position.

FIGS. 5 and 6 show a device 70 according to yet another exemplary embodiment of the invention. The device 70 comprises a receptacle body 71 having a head portion 72 mounted thereon. The head portion 72 may define a cavity 73 configured to receive an application element 74 that may be carried by a support element (e.g., flap) 75. The head portion 72 may include a sealing lip 76 that bears in a substantially leakproof manner against a neck portion 67 associated with the body 71.

The cavity 73 may be supplied with product from the reservoir defined by body 71 through openings 79.

The head portion 72 optionally has a bearing surface 80 against which the support element 75 comes to bear after pivoting through about 210°, as shown in FIG. 6. The support element 75 may be connected to the head portion 72 via a film hinge 82.

The support element 75 may have a cutout portion 83 in which a stud 84 formed on the bearing surface 80 can be snap-fastened so as to suitably hold the support element 75 in the ready position.

The support element 75 also optionally has a sealing lip 86 suitable for engaging in leakproof manner in an annular groove 87 formed in the head portion 72. This may permit the cavity 73 to be closed hermetically.

The support element 75 may have a securing mechanism 89 suitable for snap-fastening in a recess 90 of the head portion 72 in order to hold the support element in the closed position.

Figure 7:
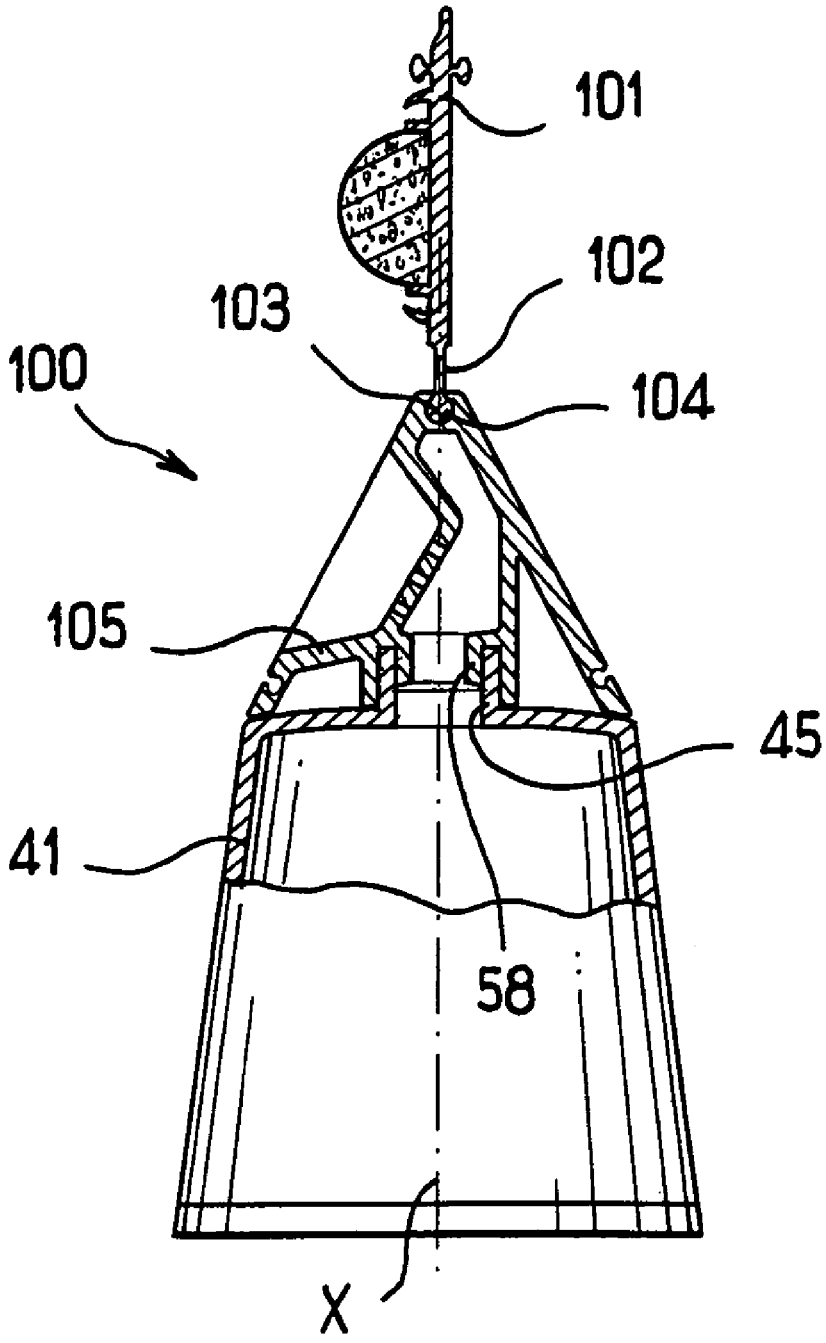
FIG. 7 is a cross-sectional view of a fourth exemplary embodiment of an application device.

In the embodiment of FIGS. 6 and 7, the axis of the cavity 73 coincides with the axis X of the receptacle body. Also, the axis Z of the applicator element may make an angle of about 60° with the axis X when in the support element is in the ready position.

The hinge 82 connecting the support element 75 to the receptacle body 71, when implemented in the form of a film hinge, may include an end portion suitable for being fitted onto the receptacle body 71.

By way of illustration, FIG. 7 shows an applicator device 100 that includes a support element 101 molded together with a film hinge 102. The hinge 102 optionally may include an end portion 103 fixed by snap-fastening in a housing 104 of a head portion 105 similar to the above-described head portion 42. The housing 104 may lie on the axis X of the receptacle body.

The film hinge 102 may be molded in an unfolded state, which may make it easier to manufacture the support element.

The hinge member 102 also may be made in the form of a hinge that provides a spring effect, tending to hold the support element in one of the closed position and the ready position. Such a spring effect hinge may include an elastically deformable portion which passes through a maximum amount of stress when the hinge is in an intermediate angular position between its extreme positions.

The invention is not limited to the embodiments described above. In particular, it is possible to use application elements of varying kinds and shapes, which may differ from those described above. For example, application elements that are compressible or otherwise, foams, sintered elements, or felts may be provided.

Moreover, the application element may be loaded with product in various ways. In particular, the application element may be loaded with product other than by exerting pressure on the wall of the receptacle so as to expel product toward the application element by means of said pressure. The application element may be loaded with product by gravity and/or by capillarity and/or by means of a pump which extracts product from the reservoir and delivers it to the application element. The application element also may be filled with product by a suction effect caused by the application element shrinking while it is in the cavity, with such an effect being caused by the application element being compressed in a leakproof manner against the side wall of the cavity.

The application element optionally may come into contact with the wall defining the corresponding cavity when the support element is in the first (i.e., closed) position.

Further, although the devices and methods have been described herein in conjunction with applying a cosmetic or care product to hair, skin, and/or nails, it is contemplated that the devices and methods can be employed to apply virtually any product to any type of surface. For example, the devices and methods could be used to apply shoe polish to shoes or to apply paint.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product, the device comprising:

a receptacle body defining a reservoir configured to contain a product;

an application element configured to apply a product to a surface;

a cavity in flow communication with the reservoir and configured to receive the application element; and a support element on which the application element is mounted, wherein the support element is mounted to pivot relative to the receptacle body between a first position wherein the application element is received in the cavity and a second position wherein the application element is at least partially exposed so as to be capable of coming into contact with a surface to which product is to be applied, wherein the application element is configured to apply product to at least one of skin, hair, toenails, and fingernails, wherein the application element is configured to remain external to the reservoir, wherein the device is configured so that the application element cannot be placed in the reservoir, and wherein the reservoir contains a product chosen from at least one of a skin product, a hair product, a toenail product and/or a fingernail product.

2. The device of claim 1, wherein the receptacle body is configured to be used as a handle for holding the device during application of product to the surface.

3. The device of claim 1, wherein the support element is configured to close the cavity when the support element is in the first position.

4. The device of claim 1, wherein the support element is configured to hermetically seal the cavity when the support element is in the first position.

5. The device of claim 4, further comprising a sealing member configured to provide the hermetic sealing when the support element is in the first position.

6. The device of claim 4, wherein the support element is configured to pivot over an angle of at least approximately 180 degrees.

7. The device of claim 1, wherein the support element is configured to pivot over an angle of at least approximately 120 degrees.

8. The device of claim 1, further comprising a hinge member associated with the support element, the support element being configured to pivot about the hinge member.

9. The device of claim 8, wherein the hinge member comprises a film hinge.

10. The device of claim 8, further comprising a head portion associated with the receptacle body, wherein the hinge member connects the support element to the head portion.

11. The device of claim 8, wherein the hinge member connects the support element to the receptacle body.

12. The device of claim 8, wherein the hinge member comprises at least one pivot configured to pivot in a housing.

13. The device of claim 8, wherein the hinge member is configured to snap-fasten to one of the support element and the receptacle body.

14. The device of claim 8, wherein the hinge member is spring-biased.

15. The device of claim 1, wherein the receptacle body is made of a relatively flexible material.

16. The device of claim 1, wherein the receptacle body is made of a relatively rigid material.

17. The device of claim 1, further comprising a securing mechanism for securing the support element in the first position.

18. The device of claim 17, wherein the securing mechanism comprises a snap-fastener.

19. The device of claim 1, further comprising a securing mechanism for securing the support element in the second position.

20. The device of claim 19, wherein the securing mechanism comprises a snap-fastener.

21. The device of claim 1, wherein a longitudinal axis of the cavity is substantially parallel to a longitudinal axis of the receptacle body.

22. The device of claim 21, wherein the longitudinal axis of the cavity is substantially coincident with the longitudinal axis of the receptacle body.

23. The device of claim 1, wherein a longitudinal axis of the cavity is at an angle relative to the longitudinal axis of the receptacle body.

24. The device of claim 23, wherein the longitudinal axis of the cavity is substantially perpendicular to the longitudinal axis of the receptacle body.

25. The device of claim 1, wherein the device is configured such that flow of a product from the reservoir into the cavity is along a direction that is substantially perpendicular to an axis about which the support element is configured to pivot.

26. The device of claim 1, wherein a longitudinal axis of the application element is substantially parallel to a longitudinal axis of the receptacle body when the support element is in the second position.

27. The device of claim 1, wherein a longitudinal axis of the application element forms a non-zero angle with a longitudinal axis of the receptacle body when the support element is in the second position.

28. The device of claim 1, wherein the support element is configured to pivot through an angle of at least approximately 210 degrees when the support element is moved from the first position to the second position.

29. The device of claim 1, wherein the cavity is defined at least partially by a wall defining at least one opening.

30. The device of claim 29, wherein the at least one opening provides the flow communication between the cavity and the reservoir.

31. The device of claim 29, wherein the at least one opening comprises a plurality of openings.

32. The device of claim 29, wherein the at least one opening comprises at least one capillary opening.

33. The device of claim 1, wherein the product is chosen from a cosmetic product and a care product.

34. The device of claim 1, further comprising a head portion associated with the receptacle body, the head portion defining the cavity.

35. The device of claim 34, wherein the head portion defines an internal passage configured to place the cavity in flow communication with the reservoir.

36. The device of claim 34, wherein the receptacle body comprises a neck portion and the head portion is configured to engage with the neck portion.

37. The device of claim 34, wherein the head portion and the receptacle body are formed as a single piece.

38. The device of claim 34, wherein the head portion is removably attached to the receptacle body.

39. A device for applying a product, the device comprising:

a receptacle body defining a reservoir configured to contain a product;

an application element configured to apply a product to a surface;

a cavity in flow communication with the reservoir and configured to receive the application element, the cavity being defined at least partially by a wall defining at least one opening; and a support element on which the application element is mounted, wherein the support element is mounted to pivot relative to the receptacle body between a first position wherein the application element is received in the cavity and a second position wherein the application element is at least partially exposed so as to be capable of coming into contact with a surface to which product is to be applied, wherein the application element is configured to apply product to at least one of skin, hair, toenails, and fingernails, wherein the reservoir contains a product chosen from at least one of a skin product, a hair product, a toenail product and/or a fingernail product, and wherein the application element is compressible and the device is configured such that product flows through the at least one opening during expansion of the application element from a compressed configuration to an uncompressed configuration when the support element moves from the first position to the second position.

40. A device for applying a product, the device comprising:

a receptacle body defining a reservoir configured to contain a product;

an application element configured to apply a product to a surface;

a cavity in flow communication with the reservoir and configured to receive the application element; and a support element on which the application element is mounted, wherein the support element is mounted to pivot relative to the receptacle body between a first position wherein the application element is received in the cavity and a second position wherein the application element is at least partially exposed so as to be capable of coming into contact with a surface to which product is to be applied, wherein the application element is made of a compressible material; and wherein the reservoir contains a product.

41. The device of claim 40, wherein the application element is configured to be in a compressed configuration when the support element is in the first position.

42. The device of claim 40, wherein the application element is configured to be in an uncompressed configuration when the support element is in the first position.

43. A method of applying a product to a surface, the method comprising:

providing a device comprising a receptacle body defining a reservoir configured to contain a product;

an application element configured to apply a product to a surface;

a cavity in flow communication with the reservoir and configured to receive the application element; and a support element on which the application element is mounted, wherein the support element is mounted to pivot relative to the receptacle body between a first position wherein the application element is received in the cavity and a second position wherein the application element is at least partially exposed so as to be capable of coming into contact with a surface to which product is to be applied, wherein the application element is configured to apply product to at least one of skin, hair, toenails, and fingernails, and wherein the reservoir contains a product chosen from at least one of a skin product, a hair product, a toenail product and/or a fingernail product;

flowing a product toward the cavity to place the product in contact with at least a portion of the application element positioned in the cavity so as to load at least a portion of the application element with the product;

placing the support element in the second position; and placing at least the loaded portion of the application element in contact with a surface so as to apply product to the surface.

44. The method of claim 43, wherein the placing of the support element in the second position comprises pivoting the support element relative to the receptacle body.

45. The method of claim 43, wherein the placing of the application element in contact with the surface comprises holding the receptacle body.

46. The method of claim 43, wherein the placing of the support element in the second position comprises securing the support element in the second position.

47. The method of claim 43, wherein the flowing of the product toward the cavity comprises exerting pressure on an outside of the receptacle body.

48. The method of claim 43, wherein the application element is compressible and the flowing of the product toward the cavity comprises permitting the application element to expand from a compressed configuration to an uncompressed configuration.

49. The method of claim 43, further comprising placing the support element in the first position after the product has been applied to the surface.

50. The method of claim 49, wherein the placing of the support element in the first position comprises securing the support element in the first position.

51. The method of claim 50, wherein the securing of the support element in the first position comprises snap-fastening the support element relative to the receptacle body.

52. The method of claim 43, wherein the flowing of the product toward the cavity comprises flowing the product through at least one opening defined in a wall defining the cavity.

53. The method of claim 43, wherein the product is chosen from a cosmetic product and a care product.

54. The method of claim 43, wherein the placing of the application element in contact with the surface comprises placing the application element in contact with at least one of skin, hair, at least one toenail, and at least one fingernail.

55. A device for applying a product, the device comprising:

a receptacle body defining a reservoir configured to contain a product;

an application element configured to apply a product to a surface;

a cavity in flow communication with the reservoir and configured to receive an application element; and a support element on which the application element is mounted, wherein the support element is mounted to move between a first position wherein the application element is received in the cavity and a second position wherein the application element is at least partially exposed so as to be capable of coming into contact with a surface to which product is to be applied, wherein the receptacle body is configured to be used as a handle portion for holding the device during application of product to the surface when the support element is in the second position, wherein the application element is configured to apply product to at least one of skin, hair, toenails, and fingernails, wherein the application element is configured to remain external to the reservoir, wherein the device is configured so that the application element cannot be placed in the reservoir, and wherein the reservoir contains a product chosen from at least one of a skin product, a hair product, a toenail product and/or a fingernail product.

56. The device of claim 55, wherein the support element is configured to close the cavity when the support element is in the first position.

57. The device of claim 55, wherein the support element is configured to hermetically seal the cavity when the support element is in the first position.

58. The device of claim 57, further comprising a sealing member configured to provide the hermetic sealing when the support element is in the first position.

59. The device of claim 55, wherein the support element is configured to pivot over an angle of at least approximately 120 degrees during movement of the support element between the first position and the second position.

60. A device for applying a product, the device comprising:

a receptacle body defining a reservoir configured to contain a product;

an application element configured to apply a product to a surface;

a cavity in flow communication with the reservoir and configured to receive an application element; and a support element on which the application element is mounted, wherein the support element is mounted to move between a first position wherein the application element is received in the cavity and a second position wherein the application element is at least partially exposed so as to be capable of coming into contact with a surface to which product is to be applied, wherein the receptacle body is configured to be used as a handle portion for holding the device during application of product to the surface when the support element is in the second position, wherein the application element is made of a compressible material, and wherein the reservoir contains a product.

61. The device of claim 60, wherein the application element is configured to be in a compressed configuration when the support element is in the first position.

62. The device of claim 60, wherein the application element is configured to be in an uncompressed configuration when the support element is in the first position.

63. The device of claim 55, further comprising a hinge member associated with the support element, the support element being configured to pivot about the hinge member.

64. The device of claim 63, wherein the hinge member comprises a film hinge.

65. The device of claim 63, further comprising a head portion associated with the receptacle body, wherein the hinge member connects the support element to the head portion.

66. The device of claim 63, wherein the hinge member connects the support element to the receptacle body.

67. The device of claim 63, wherein the hinge member comprises at least one pivot configured to pivot within a housing.

68. The device of claim 63, wherein the hinge member is configured to snap-fasten to one of the support element and the receptacle body.

69. The device of claim 63, wherein the hinge member is spring-biased.

70. The device of claim 55, wherein the receptacle body is made of a relatively flexible material.

71. The device of claim 55, wherein the receptacle body is made of a relatively rigid material.

72. The device of claim 55, further comprising a securing mechanism for securing the support element in the first position.

73. The device of claim 72, wherein the securing mechanism comprises a snap-fastener.

74. The device of claim 55, further comprising a securing mechanism for securing the support element in the second position.

75. The device of claim 74, wherein the securing mechanism comprises a snap-fastener.

76. The device of claim 55, wherein a longitudinal axis of the cavity is substantially parallel to a longitudinal axis of the receptacle body.

77. The device of claim 76, wherein the longitudinal axis of the cavity is substantially coincident with the longitudinal axis of the receptacle body.

78. The device of claim 55, wherein a longitudinal axis of the cavity is at an angle relative to the longitudinal axis of the receptacle body.

79. The device of claim 78, wherein the longitudinal axis of the cavity is substantially perpendicular to the longitudinal axis of the receptacle body.

80. The device of claim 55, wherein the device is configured such that flow of a product from the reservoir into the cavity is along a direction that is substantially perpendicular to an axis about which the support element is configured to move relative to the receptacle body.

81. The device of claim 55, wherein a longitudinal axis of the application element is substantially parallel to a longitudinal axis of the receptacle body when the support element is in the second position.

82. The device of claim 55, wherein a longitudinal axis of the application element forms a non-zero angle with a longitudinal axis of the receptacle body when the support element is in the second position.

83. The device of claim 55, wherein the support element is configured to pivot through an angle of at least approximately 210 degrees when the support element is moved from the first position to the second position.

84. The device of claim 55, wherein the cavity is defined at least partially by a wall defining at least one opening.

85. The device of claim 84, wherein the at least one opening provides the flow communication between the cavity and the reservoir.

86. The device of claim 84, wherein the at least one opening comprises a plurality of openings.

87. The device of claim 84, wherein the at least one opening comprises at least one capillary opening.

88. The device of claim 55, wherein the product is chosen from a cosmetic product and a care product.

89. The device of claim 55, further comprising a head portion associated with the receptacle body, the head portion defining the cavity.

90. The device of claim 89, wherein the head portion defines an internal passage configured to place the cavity in flow communication with the reservoir.

91. The device of claim 89, wherein the receptacle body comprises a neck portion and the head portion is configured to engage with the neck portion.

92. The device of claim 89, wherein the head portion and the receptacle body are formed as a single piece.

93. The device of claim 89, wherein the head portion is removably attached to the receptacle body.

94. A method of applying a product to a surface, the method comprising:

providing a device comprising a receptacle body defining a reservoir configured to contain a product;

an application element configured to apply a product to a surface;

a cavity in flow communication with the reservoir and configured to receive an application element; and a support element on which the application element is mounted, wherein the support element is mounted to move between a first position wherein the application element is received in the cavity and a second position wherein the application element is at least partially exposed so as to be capable of coming into contact with a surface to which product is to be applied, wherein the receptacle body is configured to be used as a handle portion for holding the device during application of product to the surface when the support element is in the second position, wherein the application element is configured to apply product to at least one of skin, hair, toenails, and fingernails, and wherein the reservoir contains a product chosen from at least one of a skin product, a hair product, a toenail product and/or a fingernail product;

flowing a product toward the cavity to place product in contact with at least a portion of the application element positioned in the cavity so as to load said at least a portion of the application element with the product;

placing the support element in the second position; and placing at least the loaded portion of the application element in contact with a surface so as to apply product to the surface.

95. The method of claim 94, wherein the placing of the support element in the second position comprises pivoting the support element relative to the receptacle body.

96. The method of claim 94, wherein the placing of the application element in contact with the surface comprises holding the receptacle body.

97. The method of claim 94, wherein the placing of the support element in the second position comprises securing the support element in the second position.

98. The method of claim 94, wherein the flowing of the product from toward the cavity comprises exerting pressure on an outside of the receptacle body.

99. The method of claim 94, wherein the application element is compressible and the flowing of the product toward the cavity comprises permitting the application element to expand from a compressed configuration to an uncompressed configuration.

100. The method of claim 94, further comprising placing the support element in the first position after the product has been applied to the surface.

101. The method of claim 100, wherein the placing of the support element in the first position comprises securing the support element in the first position.

102. The method of claim 101, wherein the securing of the support element in the first position comprises snap-fastening the support element relative to the receptacle body.

103. The method of claim 94, wherein the flowing of the product toward the cavity comprises flowing the product through at least one opening defined in a wall defining the cavity.

104. The method of claim 94, wherein the product is chosen from a cosmetic product and a care product.

105. The method of claim 94, wherein the placing of the application element in contact with the surface comprises placing the application element in contact with at least one of skin, hair, at least one toenail, and at least one fingernail.

106. A device for applying a product, the device comprising:

a receptacle body defining a reservoir configured to contain a product;

an application element configured to apply a product to a surface;

a cavity in flow communication with the reservoir and configured to receive an application element, the cavity being defined at least partially by a wall defining at least one opening; and a support element on which the application element is mounted, wherein the support element is mounted to move between a first position wherein the application element is received in the cavity and a second position wherein the application element is at least partially exposed so as to be capable of coming into contact with a surface to which product is to be applied, wherein the receptacle body is configured to be used as a handle portion for holding the device during application of product to the surface when the support element is in the second position, wherein the application element is configured to apply product to at least one of skin, hair, toenails, and fingernails, wherein the reservoir contains a product chosen from at least one of a skin product, a hair product, a toenail product and/or a fingernail product, and wherein the application element is compressible and the device is configured such that product flows through the at least one opening and during expansion of the application element from a compressed configuration to an uncompressed configuration when the support element moves from the first position to the second position.

107. A device for applying a product, the device comprising:

a receptacle body defining a reservoir configured to contain a product;

an application element configured to apply a product;

a cavity in flow communication with the reservoir and configured to receive the application element; and a support element on which the application element is mounted, the support element being connected to the receptacle body, wherein the support element is mounted to move between a first position wherein the application element is received in the cavity and a second position wherein the application element is at least partially exposed so as to be capable of coming into contact with a surface to which product is to be applied, wherein the support element is configured to remain connected to the receptacle body in the second position, wherein the application element is configured to apply product to at least one of skin, hair, toenails, and fingernails, wherein the application element is configured to remain external to the reservoir, wherein the device is configured so that the application element cannot be placed in the reservoir, and wherein the reservoir contains a product chosen from at least one of a skin product, a hair product, a toenail product and/or a fingernail product.

108. The device of claim 107, wherein the receptacle body is configured to be used as a handle for holding the device during application of product to a surface.

109. The device of claim 107, wherein the support element is configured to close the cavity when the support element is in the first position.

110. The device of claim 107, wherein the support element is configured to hermetically seal the cavity when the support element is in the first position.

111. The device of claim 110, further comprising a sealing member configured to provide the hermetic sealing when the support element is in the first position.

112. The device of claim 107, wherein the support element is configured to pivot between the first position and the second position.

113. The device of claim 112, wherein the support element is configured to pivot over an angle of at least approximately 120 degrees.

114. The device of claim 107, further comprising a hinge member associated with the support element, the support element being configured to pivot about the hinge member.

115. The device of claim 114, wherein the hinge member comprises a film hinge.

116. The device of claim 114, further comprising a head portion associated with the receptacle body, wherein the hinge member connects the support element to the head portion.

117. The device of claim 114, wherein the hinge member connects the support element to the receptacle body.

118. The device of claim 114, wherein the hinge member comprises at least one pivot configured to pivot within a housing.

119. The device of claim 114, wherein the hinge member is configured to snap-fasten to one of the support element and the receptacle body.

120. The device of claim 114, wherein the hinge member is spring-biased.

121. The device of claim 107, wherein the receptacle body is made of a relatively flexible material.

122. The device of claim 107, wherein the receptacle body is made of a relatively rigid material.

123. The device of claim 107, further comprising a securing mechanism for securing the support element in the first position.

124. The device of claim 123, wherein the securing mechanism comprises a snap-fastener.

125. The device of claim 107, further comprising a securing mechanism for securing the support element in the second position.

126. The device of claim 125, wherein the securing mechanism comprises a snap-fastener.

127. The device of claim 107, wherein a longitudinal axis of the cavity is substantially parallel to a longitudinal axis of the receptacle body.

128. The device of claim 127, wherein the longitudinal axis of the cavity is substantially coincident with the longitudinal axis of the receptacle body.

129. The device of claim 107, wherein a longitudinal axis of the cavity is at an angle relative to the longitudinal axis of the receptacle body.

130. The device of claim 129, wherein the longitudinal axis of the cavity is substantially perpendicular to the longitudinal axis of the receptacle body.

131. The device of claim 107, wherein the device is configured such that flow of a product from the reservoir into the cavity is along a direction that is substantially perpendicular to an axis about which the support element is configured to pivot during movement of the support element between the first position and the second position.

132. The device of claim 107, wherein a longitudinal axis of the application element is substantially parallel to a longitudinal axis of the receptacle body when the support element is in the second position.

133. The device of claim 107, wherein a longitudinal axis of the application element forms a non-zero angle with a longitudinal axis of the receptacle body when the support element is in the second position.

134. The device of claim 107, wherein the support element is configured to pivot through an angle of at least approximately 210 degrees when the support element is moved from the first position to the second position.

135. The device of claim 107, wherein the cavity is defined at least partially by a wall defining at least one opening.

136. The device of claim 135, wherein the at least one opening provides the flow communication between the cavity and the reservoir.

137. The device of claim 135, wherein the at least one opening comprises a plurality of openings.

138. The device of claim 135, wherein the at least one opening comprises at least one capillary opening.

139. The device of claim 107, wherein the product is chosen from a cosmetic product and a care product.

140. The device of claim 107, further comprising a head portion associated with the receptacle body, the head portion defining the cavity.

141. The device of claim 140, wherein the head portion defines an internal passage configured to place the cavity in flow communication with the reservoir.

142. The device of claim 140, wherein the receptacle body comprises a neck portion and the head portion is configured to engage with a neck portion.

143. The device of claim 140, wherein the head portion and the receptacle body are formed as a single piece.

144. The device of claim 140, wherein the head portion is removably attached to the receptacle body.

145. A device for applying a product, the device comprising:

a receptacle body defining a reservoir configured to contain a product;

an application element configured to apply a product;

a cavity in flow communication with the reservoir and configured to receive the application element, the cavity being defined at least partially by a wall defining at least one opening; and a support element on which the application element is mounted, the support element being connected to the receptacle body, wherein the support element is mounted to move between a first position wherein the application element is received in the cavity and a second position wherein the application element is at least partially exposed so as to be capable of coming into contact with a surface to which product is to be applied, wherein the support element is configured to remain connected to the receptacle body in the second position, wherein the application element is configured to apply product to at least one of skin, hair, toenails, and fingernails, wherein the reservoir contains a product chosen from at least one of a skin product, a hair product, a toenail product and/or a fingernail product, and wherein the application element is compressible and the device is configured such that product flows through the at least one opening during expansion of the application element from a compressed configuration to an uncompressed configuration when the support element moves from the first position to the second position.

146. A device for applying a product, the device comprising:

a receptacle body defining a reservoir configured to contain a product;

an application element configured to apply a product;

a cavity in flow communication with the reservoir and configured to receive the application element; and a support element on which the application element is mounted, the support element being connected to the receptacle body, wherein the support element is mounted to move between a first position wherein the application element is received in the cavity and a second position wherein the application element is at least partially exposed so as to be capable of coming into contact with a surface to which product is to be applied, wherein the support element is configured to remain connected to the receptacle body in the second position, wherein the application element is made of a compressible material, and wherein the reservoir contains a product.

147. The device of claim 146, wherein the application element is configured to be in a compressed configuration when the support element is in the first position.

148. The device of claim 146, wherein the application element is configured to be in an uncompressed configuration when the support element is in the first position.

149. A method of applying a product to a surface, the method comprising:

providing a device comprising:

a receptacle body defining a reservoir configured to contain a product;

an application element configured to apply a product;

a cavity in flow communication with the reservoir and configured to receive the application element; and a support element on which the application element is mounted, the support element being connected to the receptacle body, wherein the support element is mounted to move between a first position wherein the application element is received in the cavity and a second position wherein the application element is at least partially exposed so as to be capable of coming into contact with a surface to which product is to be applied, wherein the support element is configured to remain connected to the receptacle body in the second position, wherein the application element is configured to apply product to at least one of skin, hair, toenails, and fingernails, and wherein the reservoir contains a product chosen from at least one of a skin product, a hair product, a toenail product and/or a fingernail product;

flowing a product toward the cavity to place the product in contact with at least a portion of the application element positioned in the cavity so as to load said at least a portion of the application element with the product;

placing the support element in the second position; and placing at least the loaded portion of the application element in contact with a surface so as to apply product to the surface.

150. The method of claim 149, wherein the placing of the support element in the second position comprises pivoting the support element relative to the receptacle body.

151. The method of claim 149, wherein the placing the application element in contact with the surface comprises holding the receptacle body.

152. The method of claim 149, wherein the placing of the support element in the second position comprises securing the support element in the second position.

153. The method of claim 149, wherein the flowing of the product toward the cavity comprises exerting pressure on an outside of the receptacle body.

154. The method of claim 149, wherein the application element is compressible and the flowing of the product toward the cavity comprises permitting the application element to expand from a compressed configuration to an uncompressed configuration.

155. The method of claim 149, further comprising placing the support element in the first position after the product has been applied to the surface.

156. The method of claim 155, wherein the placing of the support element in the first position comprises securing the support element in the first position.

157. The method of claim 156, wherein the securing of the support element in the first position comprises snap-fastening the support element relative to the receptacle body.

158. The method of claim 149, wherein the flowing of the product toward the cavity comprises flowing the product through at least one opening defined in a wall defining the cavity.

159. The method of claim 149, wherein the product is chosen from a cosmetic product and a care product.

160. The method of claim 149, wherein the placing of the application element in contact with the surface comprises placing the application element in contact with at least one of skin, hair, at least one toenail, and at least one fingernail.

161. A device for applying a product, the device comprising:

a receptacle body defining a reservoir configured to contain a product;

an application element configured to apply a product to a surface;

a cavity in flow communication with the reservoir and configured to receive the application element; and a support element on which the application element is mounted, wherein the support element is mounted to pivot relative to the receptacle body between a first position wherein the application element is received in the cavity and a second position wherein the application element is at least partially exposed so as to be capable of coming into contact with a surface to which product is to be applied, wherein the application element is configured to apply product to at least one of skin, hair, toenails, and fingernails, wherein the reservoir contains a product chosen from at least one of a skin product, a hair product, a toenail product and/or a fingernail product, and wherein the device is configured to load at least a portion of the application element with product from the reservoir while the application element is positioned in the cavity.

162. The device of claim 161, further comprising a wall delimiting the reservoir and the cavity, the wall comprising at least one opening allowing fluidic communication between the reservoir and the cavity.

163. A device for applying a product, the device comprising:

a receptacle body defining a reservoir configured to contain a product;

an application element configured to apply a product to a surface;

a cavity in flow communication with the reservoir and configured to receive an application element; and a support element on which the application element is mounted, wherein the support element is mounted to move between a first position wherein the application element is received in the cavity and a second position wherein the application element is at least partially exposed so as to be capable of coming into contact with a surface to which product is to be applied, wherein the receptacle body is configured to be used as a handle portion for holding the device during application of product to the surface when the support element is in the second position, wherein the application element is configured to apply product to at least one of skin, hair, toenails, and fingernails, wherein the reservoir contains a product chosen from at least one of a skin product, a hair product, a toenail product and/or a fingernail product, and wherein the device is configured to load at least a portion of the application element with product from the reservoir while the application element is positioned in the cavity.

164. The device of claim 163, further comprising a wall delimiting the reservoir and the cavity, the wall comprising at least one opening allowing fluidic communication between the reservoir and the cavity.

165. A device for applying a product, the device comprising:

a receptacle body defining a reservoir configured to contain a product;

an application element configured to apply a product;

a cavity in flow communication with the reservoir and configured to receive the application element; and a support element on which the application element is mounted, the support element being connected to the receptacle body, wherein the support element is mounted to move between a first position wherein the application element is received in the cavity and a second position wherein the application element is at least partially exposed so as to be capable of coming into contact with a surface to which product is to be applied, wherein the support element is configured to remain connected to the receptacle body in the second position, wherein the application element is configured to apply product to at least one of skin, hair, toenails, and fingernails, wherein the reservoir contains a product chosen from at least one of a skin product, a hair product, a toenail product and/or a fingernail product, and wherein the device is configured to load at least a portion of the application element with product from the reservoir while the application element is positioned in the cavity.

166. The device of claim 165, further comprising a wall delimiting the reservoir and the cavity, the wall comprising at least one opening allowing fluidic communication between the reservoir and the cavity.

* * * * *